United States Patent [19]

Tegel, deceased et al.

[11] Patent Number: 5,076,192

[45] Date of Patent: Dec. 31, 1991

[54] UNMANNED SUBMARINE FOR AIR ROCKET

[75] Inventors: Marek Tegel, deceased, late of Wedel, by Anita Tegel, heir; Dieter Wenzel, Haseldorf, both of Fed. Rep. of Germany

[73] Assignee: DMT Marinetechnik GmbH, Hamburg, Fed. Rep. of Germany

[21] Appl. No.: 610,942

[22] Filed: Nov. 9, 1990

[30] Foreign Application Priority Data

Nov. 10, 1989 [DE] Fed. Rep. of Germany ..... 3937450

[51] Int. Cl.[5] ..... B63C 8/30

[52] U.S. Cl. ..... 114/316; 89/1.81; 114/320

[58] Field of Search ..... 114/316, 317, 320; 89/1.809, 1.81, 5, 1.816, 1.817; 244/63, 172

[56] References Cited

U.S. PATENT DOCUMENTS

| | | | |
|---|---|---|---|
| 3,301,132 | 1/1967 | Lehmann et al. | 114/316 X |
| 3,717,069 | 2/1973 | Mainhardt | 89/1.816 X |
| 4,724,738 | 2/1988 | Johnson | 89/1.809 |

FOREIGN PATENT DOCUMENTS 1115664 5/1968 United Kingdom .

*Primary Examiner*—Sherman Basinger
*Attorney, Agent, or Firm*—Spencer & Frank

[57] ABSTRACT

An unmanned submarine which is guided to the surface of the water in order to launch an air rocket contained therein and which is provided in its walls with closeable openings for the discharge of the rocket recoil gases into the surrounding water to conduct the impinging recoil gases of a launched air rocket directly out of the submarine. To create a lock for the recoil gas discharge openings which withstands high water pressures and is easily opened in the starting phase of the air rocket, the openings are disposed in the surfaces where the recoil gases impinge on the wall of the submarine, each opening is closed by a cover which is pressed out of the opening by the impinging gases, the seat for the cover in the opening is configured as an inwardly tapered conical surface, and the cover is held in the opening by a transport safety which is released by the action of the pressure of the recoil gases or the cover.

8 Claims, 3 Drawing Sheets

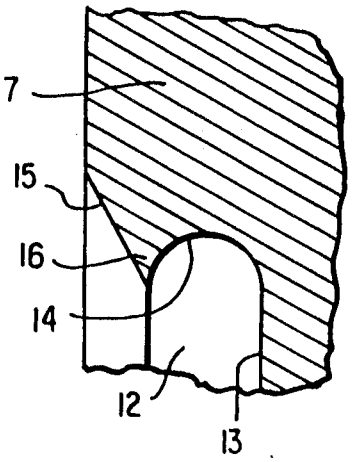
FIG. 2A
FIG. 2
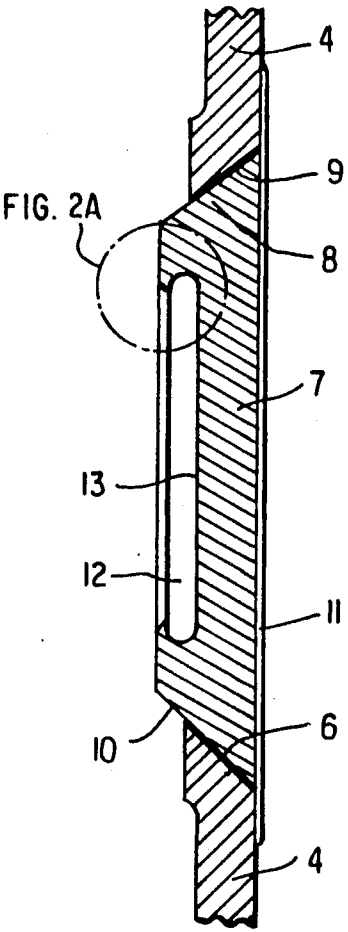
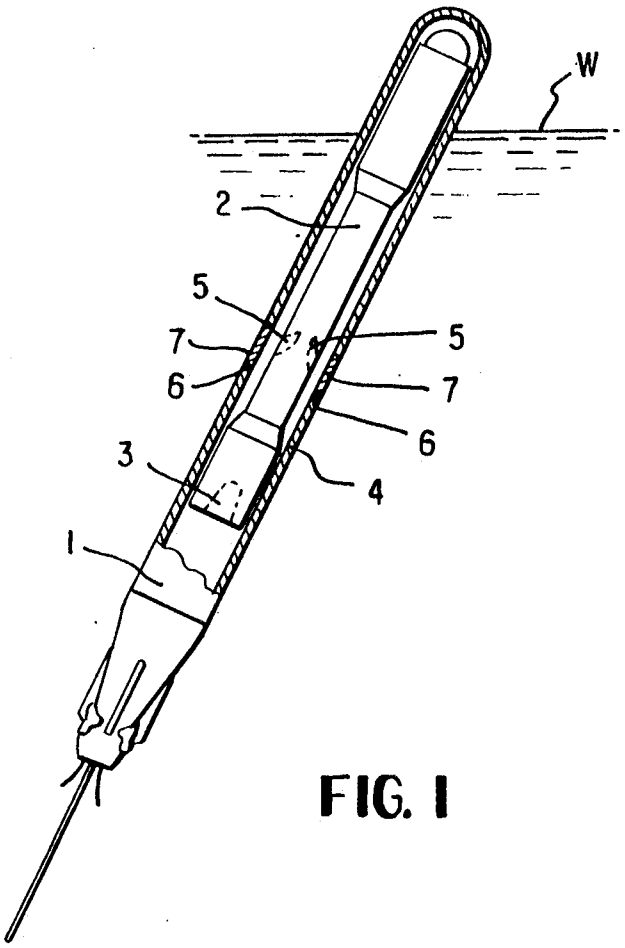
FIG. 1

UNMANNED SUBMARINE FOR AIR ROCKET

REFERENCE TO RELATED APPLICATIONS

This application claims the priority of Federal Republic of Germany application Ser. No. P 39 37 450.5 filed Nov. 10th, 1989, which is incorporated herein by reference.

BACKGROUND OF THE INVENTION

The present invention relates to an unmanned submerged vehicle or submarine for air rockets which submarine is of the type which is guided to the surface of the water to launch an air rocket and which is provided in its walls with closeable openings for discharging rocket recoil gases into the surrounding water.

Unmanned submarines or launching air rockets are disclosed, for example, in German Patent Application PS 3,917,481.6, the subject matter of which is incorporated herein by reference. In this submarine, the recoil gases of the starting air rocket are conducted out into the surrounding water through controllable nozzles which are disposed at the tail of the submarine and are provided with a controllable locking device for regulating the recoil effect. If air rockets are employed which are provided with laterally disposed start-up drive mechanisms (boosters), then conducting the recoil gases to the tail of, the vehicle poses problems since the hot gases damage heat sensitive components of the air rocket o the guide wire. The controllable locking device for the nozzles is very expensive since large pressure stresses act on the locking device in great depths of water.

SUMMARY OF THE INVENTION

It is an object of the present invention to conduct the occurring recoil gases of the starting air rocket directly away from the submarine and to provide a closing and locking arrangement for the exit openings for the recoil gases that is able to withstand high water pressures and is easily opened during the starting phase of the air rocket.

The above object is generally achieved according to the present invention by an unmanned submarine of the type which is guided to the surface of a body of water to launch an air rocket contained therein and which is provided in its walls with closable openings for discharging the rocket recoil gases formed during a launching operation into the surrounding water, and with the air rocket containing launching drives which direct recoil gases laterally toward a sidewall of the unmanned submarine during a start-up phase, wherein: the openings are disposed in at least the surfaces of the sidewall of the submarine where the recoil gases impinge during the initial start-up phase; each opening is closed by a respective cover which can be pressed out of the respective opening by the impinging recoil gases; the peripheral surface of each cover is inwardly conically tapered and a seat for the cover, formed by a laterally extending surface of the sidewall defining the respective opening, is matingly configured; and each cover is held in a respective opening by a transport safety means for releasing the cover in response to pressure produced by the recoil gases.

This solution has the advantage that the pulse energy of the recoil gases is utilized directly to open the covers with which the gas exit openings are closed and that no means are required for controlling the time sequences of the opening process. The conical seat of the cover permits the absorption of high water pressure forces and simultaneously the easy release of the cover in low or shallow water depths if the cover is charged with gas pressure forces from the interior.

Various modifications of the basic solution provided according to the invention are provided. For example, a pressure-tight seal is preferably disposed between the peripheral surface of each cover and the associated seat. Moreover, the interior surface of each cover preferably is provided with a large-area circular recess having a smooth bottom surface and an undercut circumferential portion having a configuration in which the partial recoil gas jets, formed by impingement of a main recoil gas jet on the bottom surface and conducted along the bottom surface, are deflected and returned to the main jet so that the recoil gases impinging on the cover are held in the recess until the respective opening is free. Additionally, each opening may be provided, on its circumference at the interior surface of the sidewall, with a run-in surface for the exiting recoil gases once the cover has been ejected and the air rocket has been launched. The above modifications improve, in an advantageous manner, the guidance and dissipation of the recoil gases in the interior of the submarine.

Moreover, according to an advantageous solution for the transport safety for the covers seated in the openings, a thin, slightly elastic plastic tube may be pulled over the exterior of the submarine in the region of the respective openings. This transport safety comes into effect if insufficient water pressure acts on the covers and is automatically released if recoil gases act on the covers.

One embodiment of the invention will now be described below in greater detail with reference to the drawing figures.

BRIEF DESCRIPTION OF THE DRAWINGS

FIG. 1 is a schematic illustration showing an unmanned submarine in the firing position for launching an air rocket.

FIG. 2 is a schematic enlarged cross-sectional view showing an opening in the submarine wall with a cover according to the invention for the discharge of rocket recoil gases.

FIG. 2A is a detail view of the region A of FIG. 2.

DETAILED DESCRIPTION OF THE PREFERRED EMBODIMENTS

Figure 4:
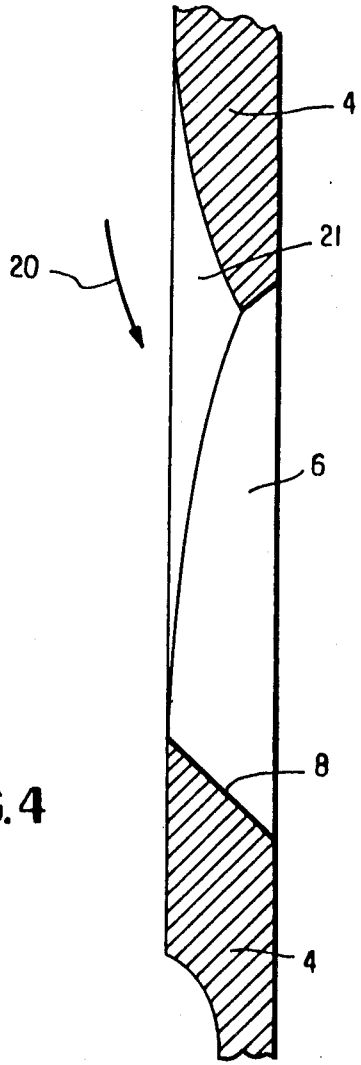
FIG. 4 is a schematic cross-sectional view of a modification of the outlet opening in the submarine wall to improve the conduction of the gas at the outlet opening upon launching of the air rocket.

FIG. 1 shows an unmanned submarine 1 having an air rocket 2 accommodated therein. To launch the air rocket 2, the submarine 1, in a known manner, is guided to the surface W of the water. The air rocket 2 is provided with start-up drive mechanisms or engines 5 (boosters) disposed on the side of the rocket body, and with a main drive mechanism 3 at its tail. Openings 6 for discharging the recoil gases are formed in the wall 4 of the submarine 1 in the surfaces exposed to the jets of rocket recoil gases from the start-up drive mechanisms 5. These openings 6 are closed by respective covers 7.

When the air rocket 2 is launched, the nose of the submarine is opened and the start-up engines 5 are fired to accelerate the air rocket to a multiple of the earth's acceleration. The main engine or drive mechanism 3 is not fired until the end of the starting phase when the rocket 2 is outside of the submarine 1. Upon firing of the engines 5, the laterally directed recoil gases hit the covers 7 and press them, against the slight pressure existing near the surface w of the water, out of the openings 6 so that the openings 6 now are released for the discharge of recoil gases into the surrounding water.

FIG. 2 shows the structural configuration of an opening 6 and a cover 7. Cover 7 has a conically tapered periphery and is seated in opening 6 by means of an inwardly tapering conical edge surface or seat 8 defining the opening 6. For the purpose of improving the guidance of cover 7 when it is pressed out of opening 6 by the rocket recoil gases, cover 7 is given a greater wall thickness than that of the surrounding wall 4 so that a guide face 10 projecting beyond the inner surface of wall 4 is formed at the conical peripheral surface of the cover 7. The peripheral surface of cover 7, when seated in opening 6, is lined by a pressure resistant seal 9 which in addition to its sealing effect also acts as corrosion protection for the respective seating or mating surfaces. The material of the seal 9 could correspond to the material of a cylinder head gasket for motor vehicle engines.

To hold covers 7 in openings 6 as long as there is no or only insufficient external water pressure, a transport safety 11 is provided. This safety 11 preferably is composed of a thin, slightly elastic plastic tube which is pulled over the submarine 1 from the outside in the region of openings 6.

Cover 7, when under the influence of the recoil gases, will easily break through the plastic tube, particularly when break locations are provided in the tube to support such breaking. Another conceivable transport safety with the same effect as that of the above described plastic tube could be an externally applied layer of paint. The use of snap locks which can be released by pressure is also conceivable for the transport safety.

According to the flow behavior of the recoil gases along smooth walls, a jet impinging on a wall at an angle will be split into partial jets and continue along the smooth wall surface without breaking off into the environment. The utilization of this fact leads to the particular configuration of the interior surface of the cover 7. As can be seen in FIG. 2, a large-area recess 12 is formed in the inner surface of the cover 7, with the recoil gas jet impinging on the bottom surface 13 of the recess 12 (see FIG. 2*a*). The lateral edge of recess 12 is extended to undercut the interior surface of the cover 7 to provide a circumferential undercut portion 14 with a semicircular shape in which propagating partial jets of the recoil gas are deflected. Moreover, beginning at the inner surface of the cover 7, recess 12 is provided with a sloped countersunk surface 15 along which the recoil gases are conducted into recess 12. This sloped countersunk surface 15, together with the outer flank of the undercut portion 14, forms a circumferential knife edge 16 at which the partial jets of the recoil gases are returned to the impinging main jet.

Figure 3:
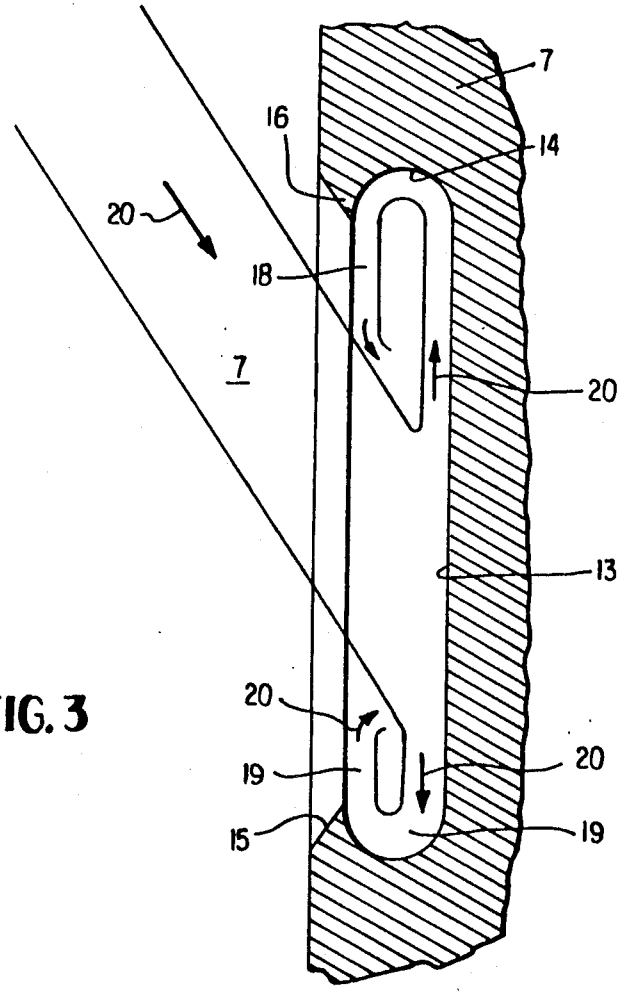
FIG. 3 is a schematic showing of the conduction of the gas in the cover before release from the gas discharge opening.
Figure 5:
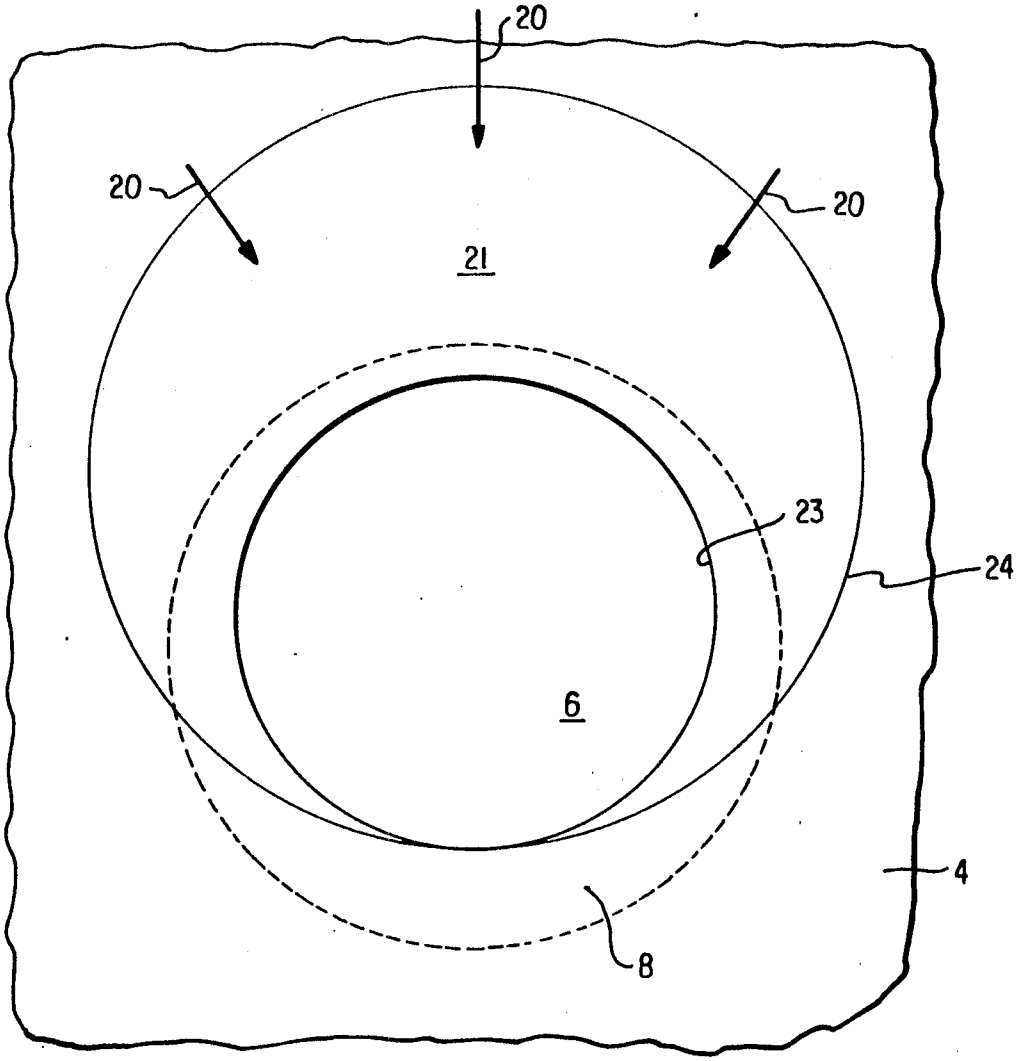
FIG. 5 shows the outlet opening of FIG. 4 in a front plan view from the left in FIG. 4.

FIG. 3 shows the flow behavior of the recoil gases in recess 12 of cover 7. The recoil gases in main jet 17, which is produced by the engine 5 and which impinge on cover 7, are split into partial jets 18 and 19 at the bottom surface 13 of recess 12. These partial jets 18 and 19 propagate along bottom surface 13 as long as the latter is sufficiently smooth and are deflected into the undercut portion 14. By means of knife edge 16, the respective deflected partial gas jets 18 and 19 are brought out of undercut portion 14 in such a manner that the partial gas jets will not exit from recess 12 but rather, when impinging on the main jet 17, will be carried along by the latter in the direction of the bottom surface 13. The movement arrows 20 show the directions of flow of the main gas jet 17 and the partial gas jets 18 and 19. Other shapes than the illustrated semicircular shape, for example, a rectangular shape can also be used to deflect the partial jets 18, 19 in the undercut portion 14. The depth of recess 12 must be such that it is possible to deflect and to return the partial jets 18, 19 without creating a current.

The gas discharge upon launching of rocket 2 may also be improved in that a plurality of openings 6 and covers 7 are arranged vertically above one another in the direction toward the nose of the vessel 1 and are opened in succession by the recoil gases of the lifting rocket 2.

The invention now being fully described, it will be apparent to one of ordinary skill in the art that any changes and modifications can be made thereto without departing from the spirit or scope of the invention as set forth herein.

What is claimed is:

1. In an unmanned submarine which is guided to the surface of a body of water to launch an air rocket contained therein and is provided in its walls with closable openings for discharging rocket recoil gases formed during a launching operation into the surrounding water, and wherein the air rocket contains launching drives which direct recoil gases laterally toward a sidewall of said unmanned submarine during a start-up phase; the improvement wherein: said openings are disposed at least in the surfaces of said sidewall of said submarine where said recoil gases impinge during said startup phase; each said opening is closed by a respective cover which can be pressed out of the respective said opening by the impinging recoil gases; the peripheral surface of each said cover is inwardly conically tapered and a seat for said cover, formed by a laterally extending surface of said sidewall defining the respective opening, is matingly configured; and each said cover is held in a respective said opening by a transport safety means for releasing the cover in response to pressure produced by the recoil gases.

2. An unmanned submarine as defined in claim 1 further comprising a respective pressure-tight seal disposed between said peripheral surface of each said cover and the associated respective said seat.

3. An unmanned submarine as defined in claim 1 wherein each said cover is thicker than said sidewall.

4. An unmanned submarine as defined in claim 1 wherein said transport safety means comprises a thin, slightly elastic plastic tube pulled over the exterior of said submarine in the region of the respective said openings.

5. An unmanned submarine as defined in claim 1 wherein the interior surface of each said cover is provided with a large-area circular recess having a smooth bottom surface and a circumferential portion which undercuts said interior surface of said cover and which has a configuration in which the partial recoil gas jets, formed by impingement of a main recoil gas jet on said bottom surface and conducted along said bottom surface, are deflected and returned to said main jet so that the recoil gases impinging on said cover are held in said recess until the respective said opening is free.

6. An unmanned submarine as defined in claim 5, wherein said recess is provided with an inwardly sloped countersunk surface which extends from said interior surface of said cover to conduct the recoil gases into said recess, and which forms a circumferential knife edge, at which said partial jets of the recoil gases are returned into said main recoil gas jet, with an outer flank of said undercut portion.

7. An unmanned submarine as defined in claim wherein each said opening is provided, on its circumference at an interior surface of said sidewall, with a run-in surface for the exiting recoil gases once the cover has been ejected and the air rocket has been launched.

8. An unmanned submarine as defined in claim 1 wherein additional openings are provided in the wall, with these additional openings being arranged one on top of the other in a vertical line, all oriented toward the head of the submarine and opened in succession by the recoil gases of the lifting air rocket.

* * * * *